US010253511B2

(12) United States Patent
Sollars

(10) Patent No.: US 10,253,511 B2
(45) Date of Patent: Apr. 9, 2019

(54) MULTI-FLEX FORMING SYSTEM

(71) Applicant: Donald Sollars, San Jose, CA (US)

(72) Inventor: Donald Sollars, San Jose, CA (US)

( * ) Notice: Subject to any disclaimer, the term of this patent is extended or adjusted under 35 U.S.C. 154(b) by 0 days.

(21) Appl. No.: 15/581,166

(22) Filed: Apr. 28, 2017

(65) Prior Publication Data

US 2017/0314276 A1 Nov. 2, 2017

Related U.S. Application Data

(60) Provisional application No. 62/329,619, filed on Apr. 29, 2016.

(51) Int. Cl.

| | |
|---|---|
| ***B28B 1/14*** | (2006.01) |
| ***B28B 7/24*** | (2006.01) |
| ***E04B 1/16*** | (2006.01) |
| ***E04B 2/84*** | (2006.01) |
| ***E04G 11/02*** | (2006.01) |
| ***E04G 11/08*** | (2006.01) |
| ***E04G 17/06*** | (2006.01) |

(52) U.S. Cl.

CPC ..... *E04G 11/02* (2013.01); *B28B 1/14* (2013.01); *B28B 7/241* (2013.01); *E04B 1/16* (2013.01); *E04B 1/162* (2013.01); *E04B 2/84* (2013.01); *E04G 11/08* (2013.01); *E04G 17/06* (2013.01)

(58) Field of Classification Search

CPC ..... E04G 11/02; E04G 11/08; E04G 17/06; E04B 1/16; E04B 1/162; E04B 2/84

See application file for complete search history.

(56) References Cited

U.S. PATENT DOCUMENTS

| | | | | | |
|---|---|---|---|---|---|
| 1,579,822 | A * | 4/1926 | Knickerbocker | A63H 33/102 | 249/192 |
| 2,511,584 | A * | 6/1950 | Hill | E04G 11/10 | 249/192 |
| 3,490,729 | A * | 1/1970 | Hiller | E04G 11/02 | 249/170 |
| 3,689,019 | A * | 9/1972 | Ferenc | E04G 11/02 | 249/13 |
| 3,826,460 | A * | 7/1974 | Cast | E04G 11/02 | 249/210 |
| 4,426,060 | A * | 1/1984 | Csont | E04G 11/02 | 249/13 |
| 4,624,440 | A * | 11/1986 | Buchler | E01D 21/00 | 249/159 |
| 2002/0121586 | A1* | 9/2002 | Gates | E04G 11/14 | 249/45 |

(Continued)

*Primary Examiner* — Brian D Mattei

(74) *Attorney, Agent, or Firm* — Schwabe, Williamson & Wyatt, P.C.

(57) ABSTRACT

Apparatuses and methods associated with creating a form to construct a concrete structure (e.g., a concrete building). In embodiments, an apparatus may comprise a number of forming system components, including but are not limited to a plurality of fixed or adjustable posts; a plurality of fixed or adjustable roof struts, a plurality of fixed or extensible frames; and/or a plurality of mounts. The fixed/adjustable posts, the fixed/adjustable roof struts, and the fixed/extensible frames are selectively and adjustably coupled together to create a form of selected dimensions to construct the concrete structure/building on site with reduced number of pours, e.g., a single pour. Other embodiments may be disclosed or claimed.

17 Claims, 22 Drawing Sheets

(56) References Cited

U.S. PATENT DOCUMENTS

| | | | | |
|---|---|---|---|---|
| 2004/0093817 | A1* | 5/2004 | Pujol Barcons | E02D 27/01 52/294 |
| 2011/0278432 | A1* | 11/2011 | Sollars | E04G 9/08 249/189 |
| 2011/0285044 | A1* | 11/2011 | Sollars | E04G 13/00 264/31 |
| 2013/0019563 | A1* | 1/2013 | Bishop | E04H 9/14 52/742.14 |
| 2014/0265027 | A1* | 9/2014 | Kreizinger | E04G 11/02 264/299 |
| 2016/0053486 | A1* | 2/2016 | Agda | E04G 11/02 52/220.8 |
| 2016/0298344 | A1* | 10/2016 | Wang | E04G 11/02 |

* cited by examiner

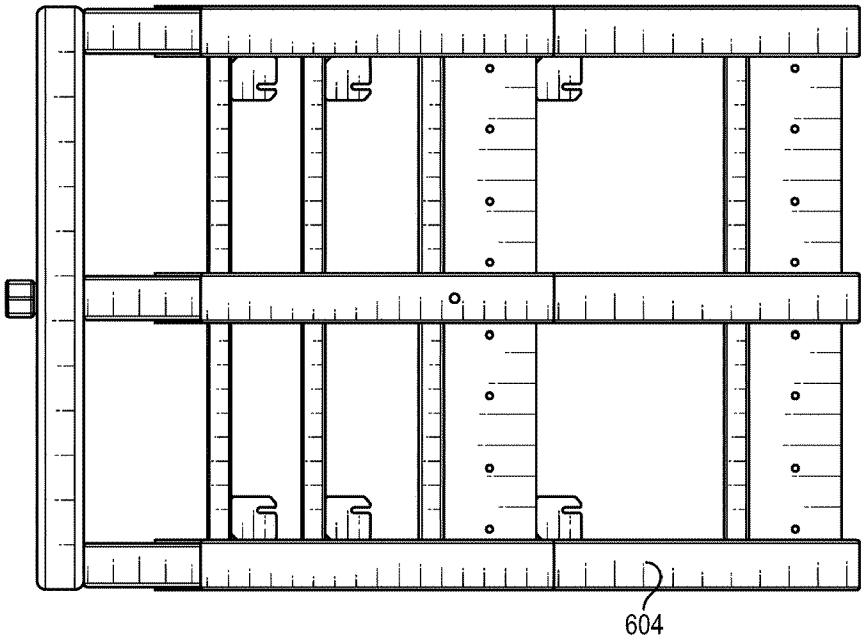
FIG. 6
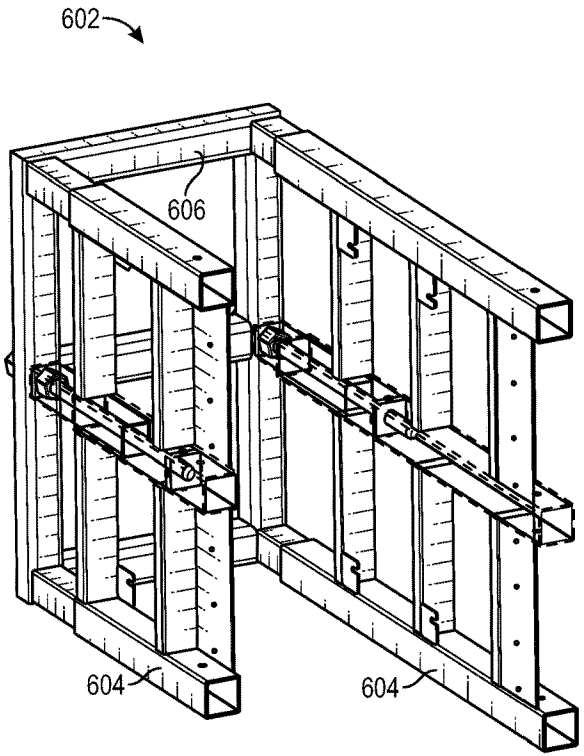

MULTI-FLEX FORMING SYSTEM

RELATED APPLICATION

This is a non-provisional application of U.S. Provisional Application 62/329,619, entitled Multi-Flex Forming System, filed on Apr. 29, 2016, and claims priority of said 62/329,619 application. The Specification of the 62/329,619 application is hereby incorporated by reference.

TECHNICAL FIELD

The present disclosure relates to the fields of building technology. In particular, the present disclosure is related to a forming system for constructing a concrete building.

BACKGROUND

The background description provided herein is for the purpose of generally presenting the context of the disclosure. Unless otherwise indicated herein, the materials described in this section are not prior art to the claims in this application and are not admitted to be prior art by inclusion in this section.

With the increase in affordable housing shortage, there is a need for a more efficient approach to constructing a building. Traditionally, pre-fabricated housing, such as concrete buildings, are put together through tilting-up of various concrete walls or casting components of a structure in a factory, and tying them together at the site. These concrete buildings and the manner of constructions suffer from a number of disadvantages. Tilt-up structures require multiple pours and large areas for the panels to be cast on the ground, while components made in a factory are limited by the weight that can be transported. In both cases, tying separate components together can be challenging due to the weight of the individual items, and the connection points/planes where the components join together are inherently weaker than the surrounding material.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, and not by way of limitation, in the figures of the accompanying drawings.

FIG. 6 illustrates example independent extension sections on both sides of a U-shaped frame, according to various embodiments.

DETAILED DESCRIPTION

Figure 1:
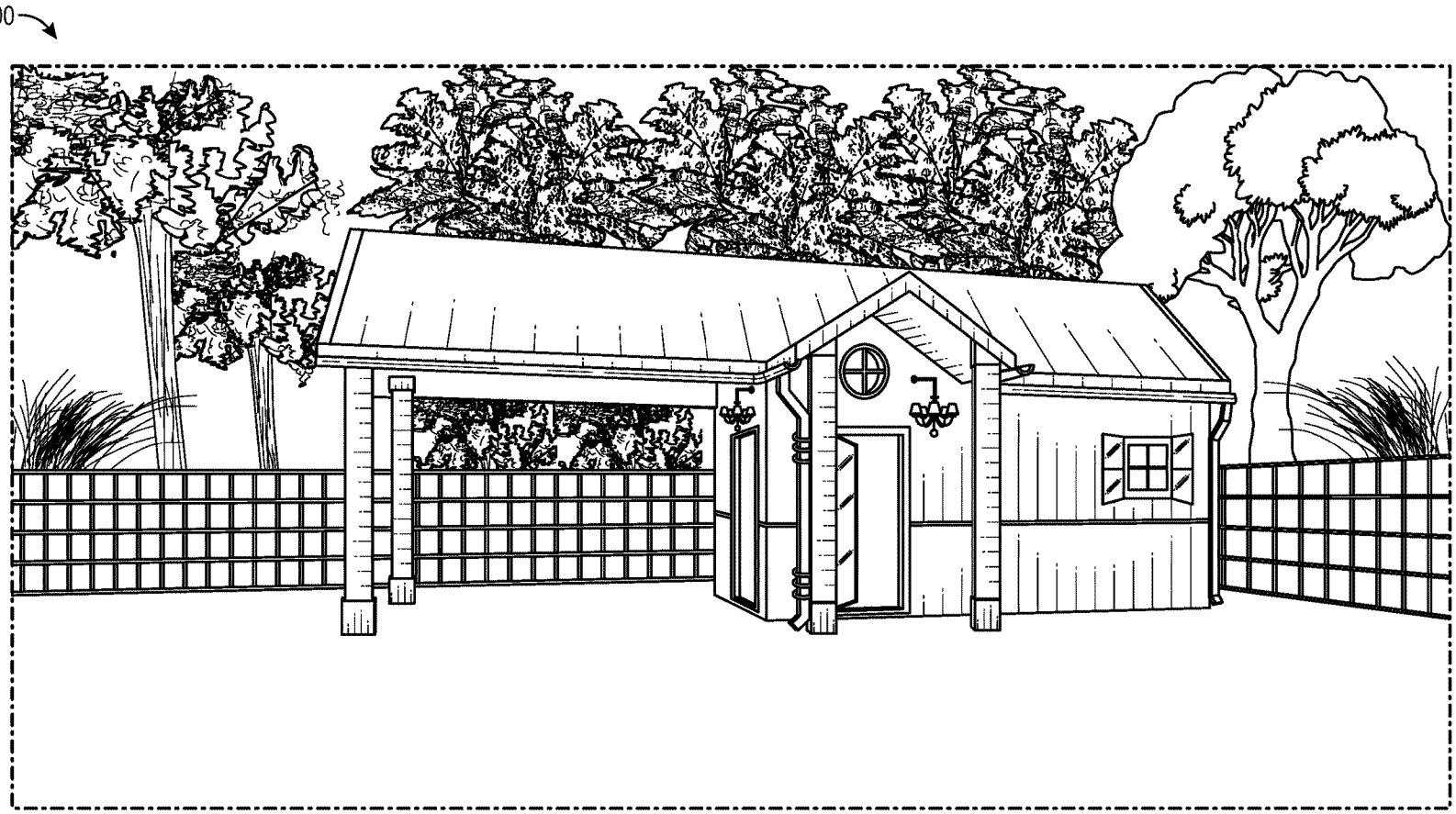
FIG. 1 illustrates a perspective view of a finished building constructed using the Multi-Flex Forming System of the present disclosure, in accordance with various embodiments.

Apparatuses and methods associated with creating a form to construct a concrete structure, e.g., a concrete building, are disclosed. In embodiments, an apparatus may comprise a number of forming system elements, including but not limited to a plurality of fixed or adjustable posts; a plurality of fixed or extensible frames; a plurality of fixed or adjustable roof struts, and/or a plurality of mounts. The fixed/adjustable posts, the fixed/extensible frames and/or the fixed/adjustable roof struts are selectively and adjustably coupled together to create a form of selected dimensions to construct the concrete structure (e.g., the concrete building) on site with reduced number of pours, e.g., a single pour. In embodiments, the apparatus may further comprise a plurality of ties to tie the fixed/adjustable posts, the fixed/extensible frames and/or the fixed/adjustable roof struts together to create the form. Facings may be removably attached to the form, optionally using magnetic attachments, to create the cavities to facilitate pouring of the concrete.

As will be apparent from the further description to follow, a resulting form may be adjustable. The form may be retractable and/or collapsible. The facings that touch the concrete may be decoupled from the forming system elements that provide the strength to resist the lateral force of the wet concrete, such that the forming system elements can vary independently.

In embodiments, the adjustable posts may be formed from a family of post components, particularly suitable for supporting multiple stories. In embodiments, the forming system components may further include bolt on stubs that would enable a blank post to be configured into one or more of the fixed/adjustable plurality of posts as needed for creating a particular form (for a particular concrete structure/building). In embodiments, the forming system components may further include a family of fixed or adjustable connectors and/or eave plates with stubs to be selectively mated with selected ones of the fixed/adjustable posts to support a variety of ceilings and/or eaves. In embodiments, the forming system components may including mount points and mount plates that serve to tie the fixed/adjustable posts together at the bottom but also locate the posts to enable correct creation of the form on-site.

In embodiments, one or more of the plurality of fixed or extensible frames may include a single tube frame with an internal drive screw that provides a point to point stub mount. In embodiments, the forming system components may further include sliding stubs to enable the frames to step up or down with grade changes, and the combination of fixed and sliding stubs to expand the range of adjustment to create the form. Further, hybrid frame and post combinations may be formed using the forming system elements. Selected ones of a plurality of extensible frames and/or hybrid frames may be used that are adjustable in at least 2 axes and/or with multiple degrees of freedom.

Referring now to FIG. 1, wherein a perspective view of an example finished building constructed using the Multi-Flex Forming technology of the present disclosure, in accordance with various embodiments, is shown. While the example finished building 100 is a single story building, it should be noted that the illustration is not meant to be limiting on the Multi-Flex Forming System of the present disclosure. As will be understood from the description to follow, the Multi-Flex Forming System of the present disclosure may be used to construct any building of 1, 2 or more stories.

Figure 2:
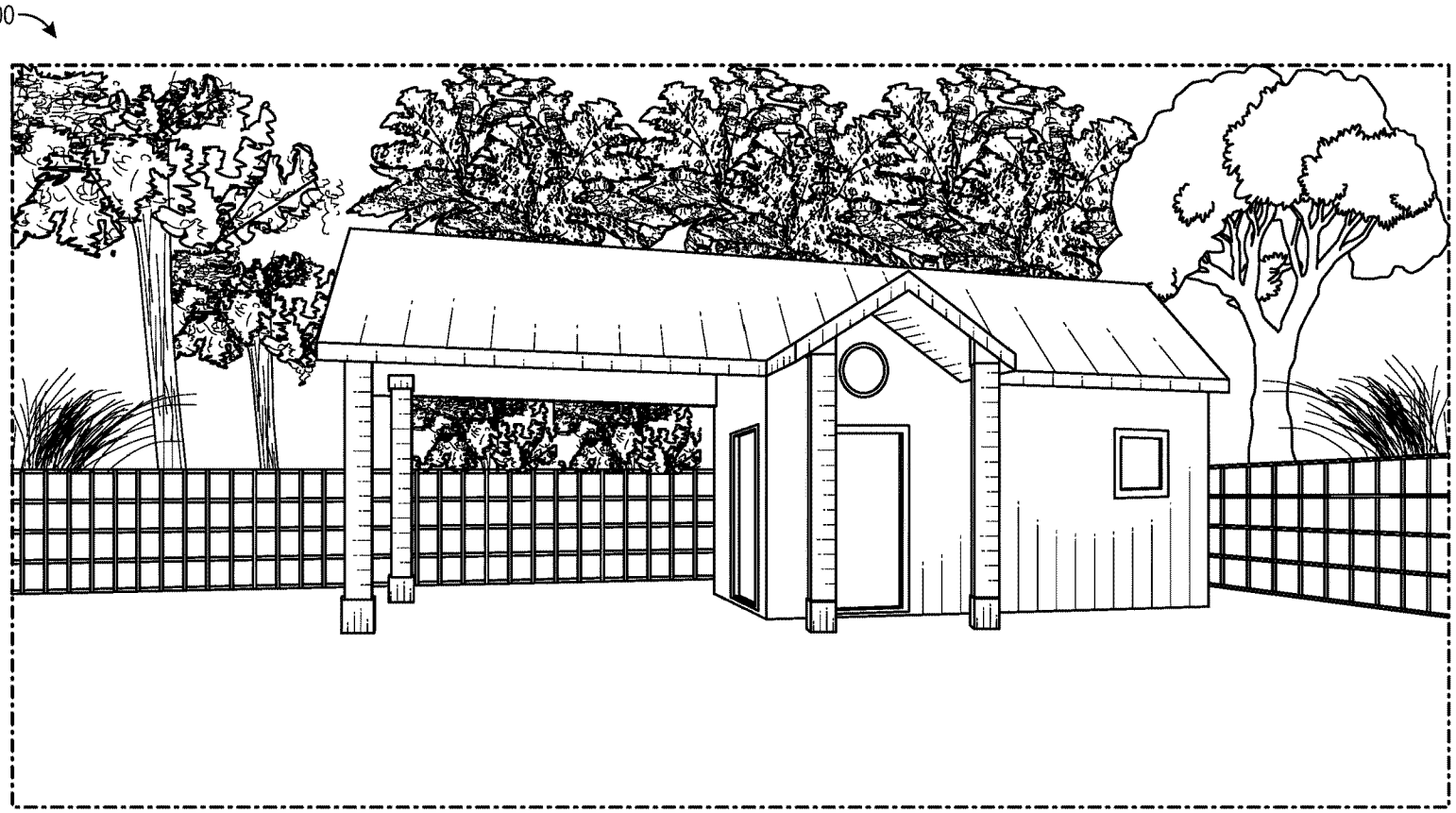
FIG. 2 illustrates a perspective view of the building of FIG. 1 in a raw initial constructed state, in accordance with various embodiments.

FIG. 2 illustrates a perspective view of the example building of FIG. 1 in a raw initial constructed state, in accordance with various embodiments. As will be described in more detail below, the Multi-Flex Forming System of the present disclosure, in addition of allowing building 200 to be formed on site, also enables the number of concrete pours required to form building 200 to be significantly reduced. If desired, building 200 may be formed such that it can be constructed in a single concrete pour.

Figure 3:
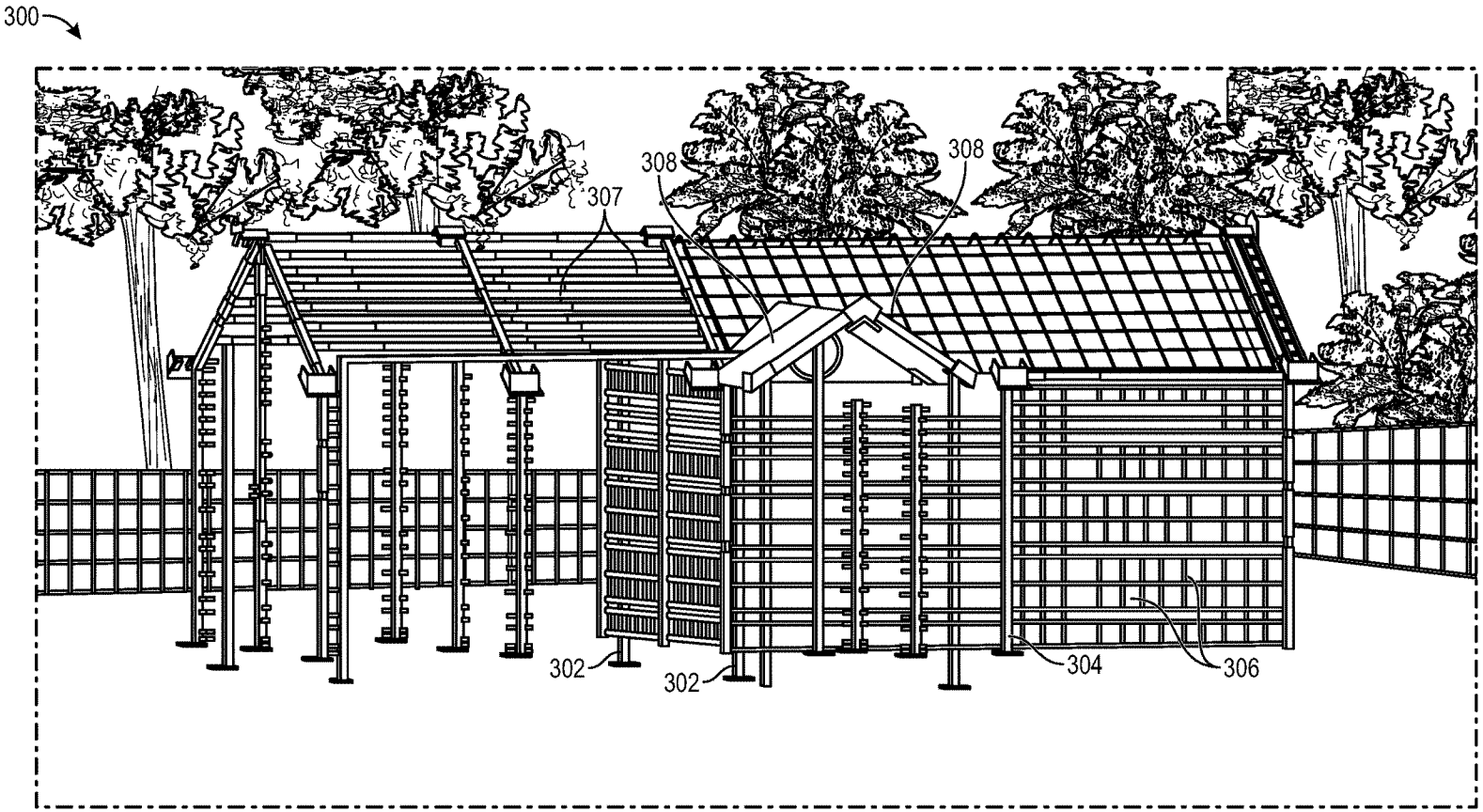
FIG. 3 illustrates a partially exposed perspective view of the Multi-Flex Forming System used to construct the building of FIGS. 1 & 2, in accordance with various embodiments.

FIG. 3 illustrates a partially exposed perspective view of the Multi-Flex Forming System used to construct the building of FIGS. 1 & 2, in accordance with various embodiments. As shown, the Multi-Flex Forming; System 300 comprises a number of forming system components, including but not limited to a number of fixed/adjustable mounts 302, fixed/adjustable posts 304, fixed/extensible frames 306, fixed/adjustable roof struts 307, facing 308, and/or ties that work together. The combination of these forming system components 302-308 can be used to form a 6-sided (or more, given that angles are supported) box/building, having an arbitrary shape. The combination also supports the concatenation of an indefinite number of boxes/buildings having common sides to facilitate an arbitrarily complex shape that can be created. In particular, the combination of these components 302-308 allow the boxes/buildings to be formed with reduced number of pours, if desired, as little as a single pour, such that there may be no weak spots or planes in the casting such as in a standard forming system where a single plane is cast at a time. In other words, the combination of components 302-308 provides the ability to monolithically cast most structures.

Further, the system 300 may be scaled to provide the strength to handle the (larger) radial load of the wet concrete in the walls while simultaneously supporting the gravity load of the second floor and concrete roof. If desired, the system 300 may also be scaled to handle multi-story buildings with more than two levels.

Additionally, the dimensional accuracy of the system components 302-308 enables a builder to survey in and establish precise mount points, such that the formwork is correct by construction, assuming the design is consistent and the mount points are set correctly. As will be described in more detail below, the posts 304 may be adjustable in the Z direction. Accordingly, the elevation of the mount points can vary due to site conditions. Further, the mount points may work together with the posts to "suspend" one or both sides of the formwork, which is a capability not found in any other prior art system.

Further, the Multi-Flex Forming (™) system 300 decouples the elements that touch the concrete (i.e. the "facing") from the elements that maintain the desired shape of the concrete (i.e. the "cage"). [Note that most of the facing elements are not shown. Only the interior facing is shown.] This capability enables a builder to use wood panels as the facing for the interior formwork, and then leave these panels in place to become the non-structural wood frame interior. The panels that remain in place may also be used to reference the locating of the interior drainage system, hot/cold water supply, gas, sewer, electrical wires/conduits, electrical boxes, heating/ventilating/air conditioning components, fire sprinklers, and rebar. This capability also allows the concrete to be textured without the need to create special form pieces.

Still further, decoupling the "cage" from the "facing" allows the Multi-Flex Forming System 300 to facilitate casting of virtually anything that can be drawn. For example, suppose someone wanted an appendage on the top of their house that was a scale model of the center "bulb" in the Taj Mahal. A rectangular cage that was large enough to encompass the scale model may be designed, and then a 3D printer or multi-axis machining center may be used to create a group of specially machined pieces that created the exact shape of the bulb and then secure these pieces to the cage to create the outside of the bulb. If the bulb was hollow on the inside, a cage that was small enough to fit inside the bulb may be created, and then use the same process to create a 3D surface that would be the inside of the bulb surface, while leaving enough room for the concrete.

FIGS. 4-22 illustrate the various components of the Multi-Flex Forming System, in accordance with various embodiments.

Figure 4:
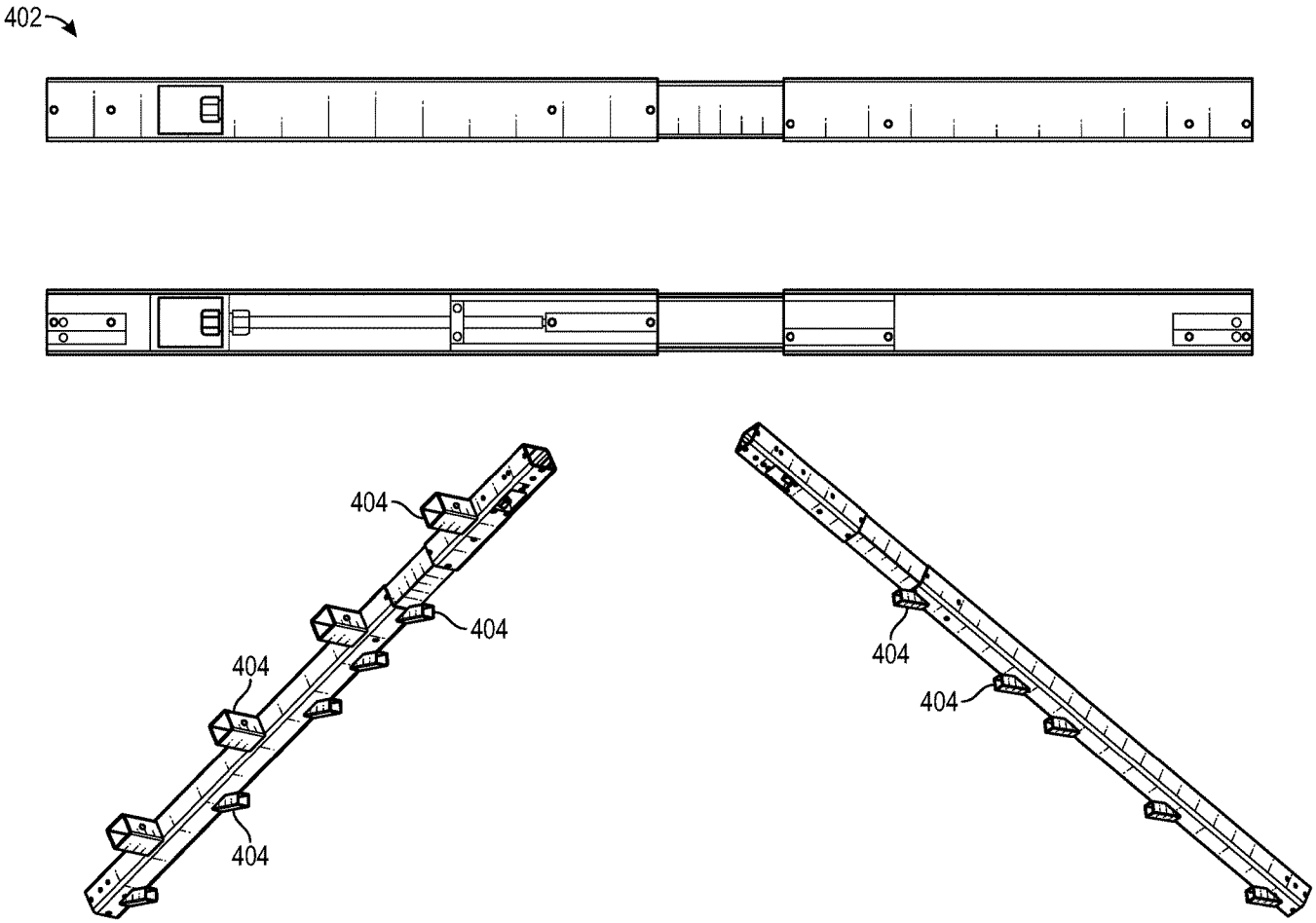
FIG. 4 illustrates a front view, a back view and a couple of perspective views of a number of single tube frames used to support the formation of the ceiling/roof, in accordance with various embodiments.

More specifically, FIG. 4 illustrates a front view, a back view and a couple of perspective views of a number of single tube frames 402 used to support the formation of the ceiling/roof, in accordance with various embodiments. The single-tube frames 402 may also be referred to as "struts". As shown, these single tube frames 402 may have stubs 404 mounted on one side, on opposing sides, or on adjacent sides to carry additional roof struts and/or gable wall forms as shown in the 2 bottom pictures.

Figure 5:
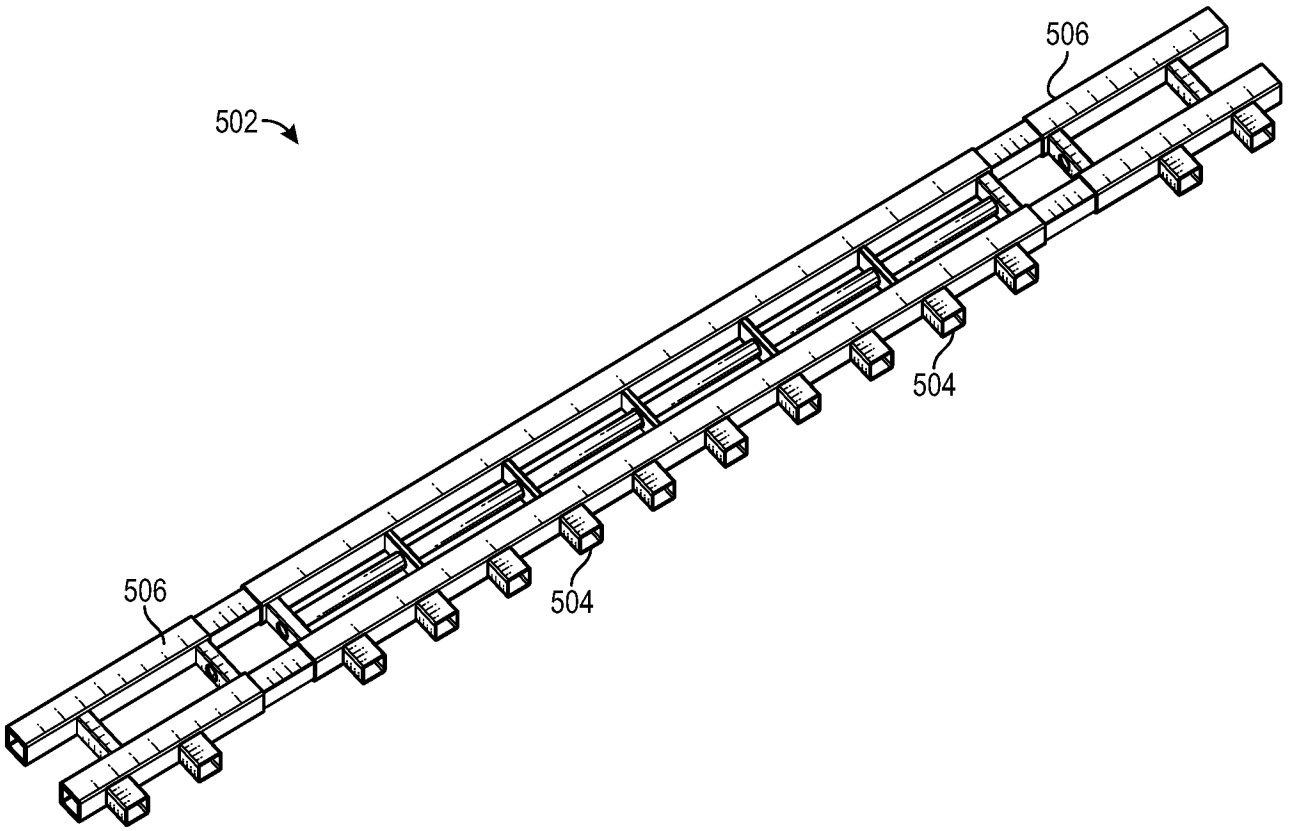
FIG. 5 illustrates a number of single and multi-tube tube frames used to support the formation of a second level floor, in accordance with various embodiments.

FIG. 5 illustrates a number of single and multi-tube tube frames used to support the formation of a second level floor, in accordance with various embodiments. As illustrated, these single and multi-tube frames 502 may have stubs 504 mounted to them at 90 degrees to the primary plane of the single and multi-tube frame to carry the second floor or define the top of the floor slab to be formed. The example frame 502 is shown with multiple independent extension sections 506 that enable the frame to be completely decoupled from the posts that carry it on both sides such that the frame can be lifted straight up to remove it. A double-extended frame also enables the fixed section of the frame to be precisely positioned as desired, a capability that is useful to enable the facing to be bolted to the frame for ease of installation.

FIG. 6 illustrates example independent extension sections on both sides of a U-shaped frame, according to various embodiments. The resulting U-shaped frame 602 may be used to perform a blockout function around a door, so that people can enter the interior space, while concrete is being poured to construct the building on site. The example frame uses multiple independent extension sections 604 having differing lengths allowing the core and jacket cages to be displaced from each other, for example, by the thickness of the wall. The example unit shown is 2' tall, but someone skilled in the art can appreciate that a taller form could be constructed such that a single form could be used for a standard 6'-8" tall doorway. The U-shaped frame 602 is constructed with the drive screw inside the retracting tube assembly. Someone skilled in the art will appreciate that this increases the strength of the overall assembly and shields the drive screw, thus providing for safer usage. Further, the illustrated embodiment utilizes a fixed frame 606 for the center "leg" of the U-shaped frame, but the center section could also utilize a fixed and adjustable frame combination to make the overall assembly adjustable with 3 degrees of freedom such that a single unit can accommodate buildings having varying wall thicknesses or the usage of interior and exterior facing having varying thicknesses.

Figure 7:
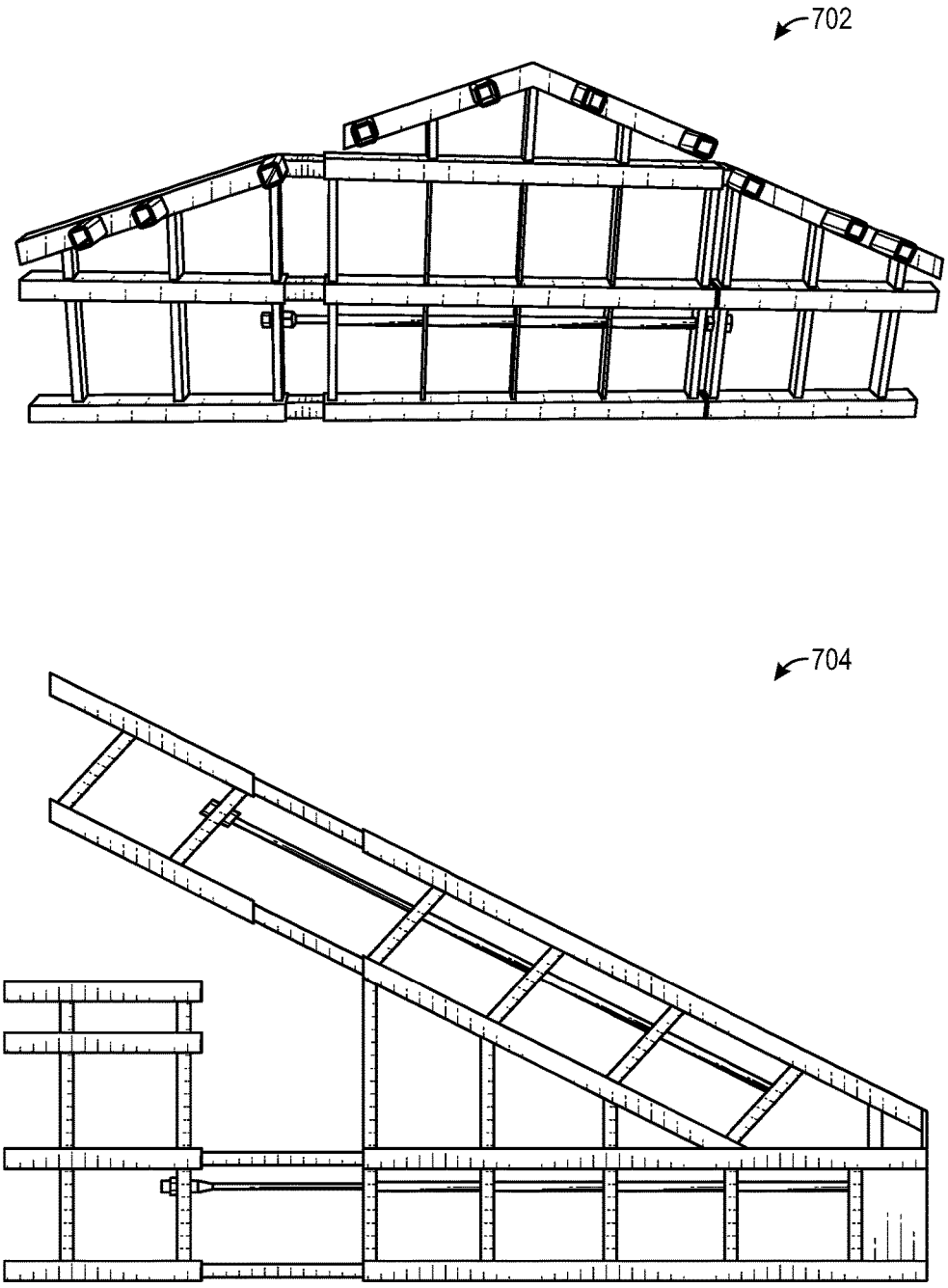
FIG. 7 illustrates an example pair of opposing extension sections on a single fixed frame to facilitate forming a gable roof of the building, and an example frame that has a single fixed section with a pair of adjustable sections that may be out of plane with respect to each other, according to various embodiments.

The top picture of FIG. 7 illustrates an example pair of opposing extension sections 702 on a single fixed frame to facilitate forming a gable roof of the building, and with perpendicular stubs added to carry the weight of the ceiling being formed, according to various embodiments. The lower picture of FIG. 7 is an example frame 704 (an alternate embodiment) that has a single fixed section with a pair of adjustable sections that may be out of plane with respect to each other (versus the top picture where the 2 adjustable sections are opposing each other in the same plane).

In still other embodiments, the frame may have an L-shaped fixed section with adjustable extension sections on both sides to achieve a frame that is adjustable in 2 dimensions. Someone skilled in the art could appreciate that the L-shaped fixed frame could be tall and a single piece with the extension sections broken down into multiple shorter independent entities so that the extension sections would not "bind up" when being driven under tension. This frame may be particularly useful for short jogs in a wall of the building being formed.

Figure 8:
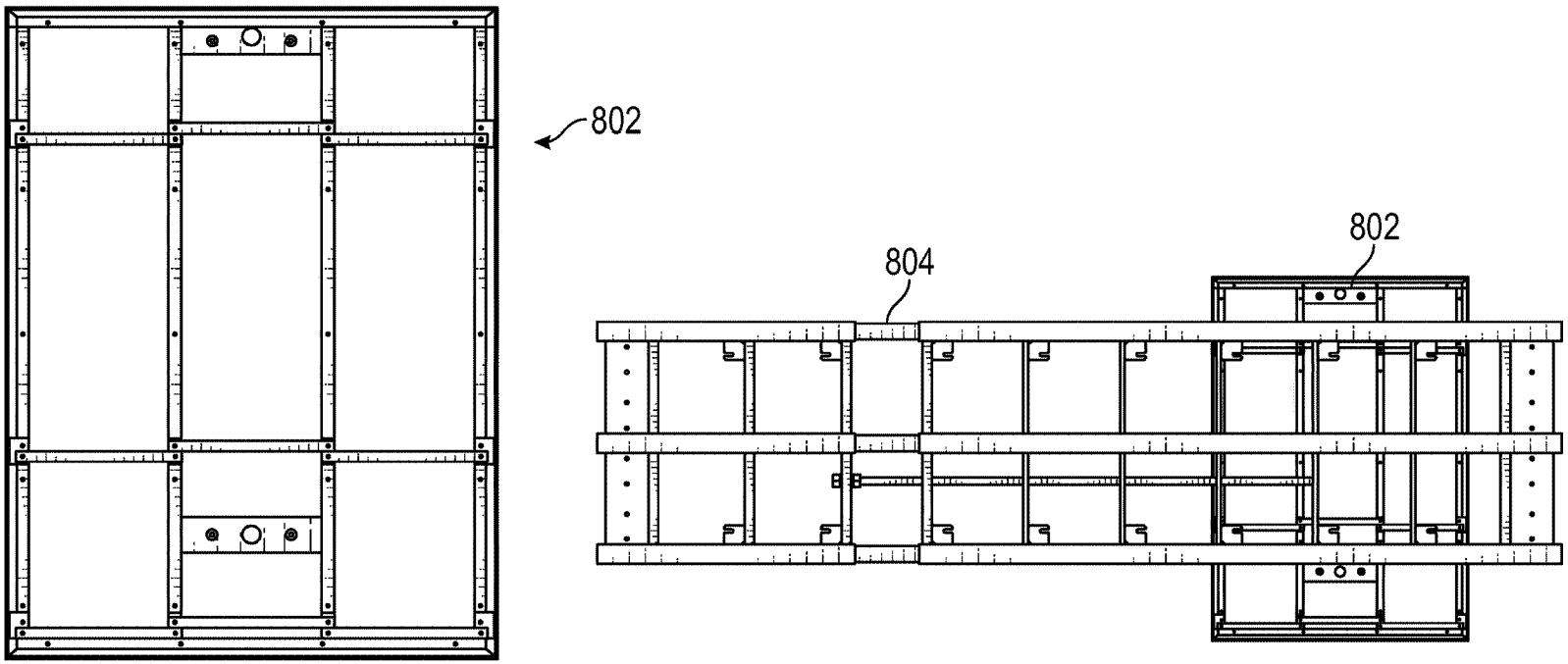
FIG. 8 illustrates the example use of magnetic bases to attach facing to the frames, according to various embodiments.

FIG. 8 illustrates the example use of magnetic bases to attach facing to the frames, according to various embodiments. In the example shown, the facing 802 may be comprised of an aluminum skin with a steel frame attached to it. The magnetic bases may be mounted to the frames 804 using the square gussets welded in the corners, and the frame 804 is designed such that it aligns with the magnetic bases. In alternate embodiments, a facing design where a layer of plastic is laminated over a thin sheet of steel may also be practiced. Someone skilled in the art will appreciate that the gussets in the corners can also be used to attach and secure plywood facing or wood panels as described earlier.

Figure 9:
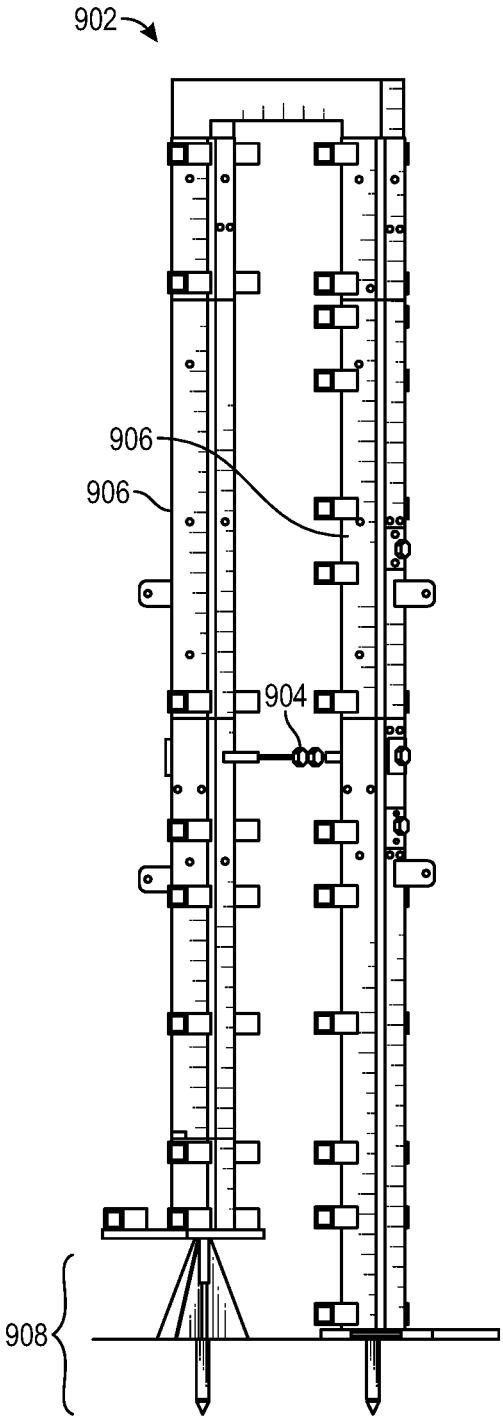
FIG. 9 illustrates example stub trees (used on posts, struts, and frames), according to various embodiments.

FIG. 9 illustrates example stub trees (used on posts, struts, and frames). These stub trees provide the ability to quickly and independently establish the elevations for the top and bottom of multiple floors and then the roof of the building being formed, according to various embodiments. The example portion of the multi-flex form 902 may be formed by tying 904 two opposing posts 906 together and mount the entire assembly on a mother plate 908. The mother plate 908 (see also 2002 of FIG. 20) can be surveyed in to precisely locate the posts, which may be installed as a pair. The mother plate 908 may serve to mount the posts but may also serve as the bottom tie to make sure that the posts don't move due to the pressure of the wet concrete. [NOTE: A mother plate is an example of a mount point, and is shown in the left-most picture in FIG. 9.]

Figure 10:
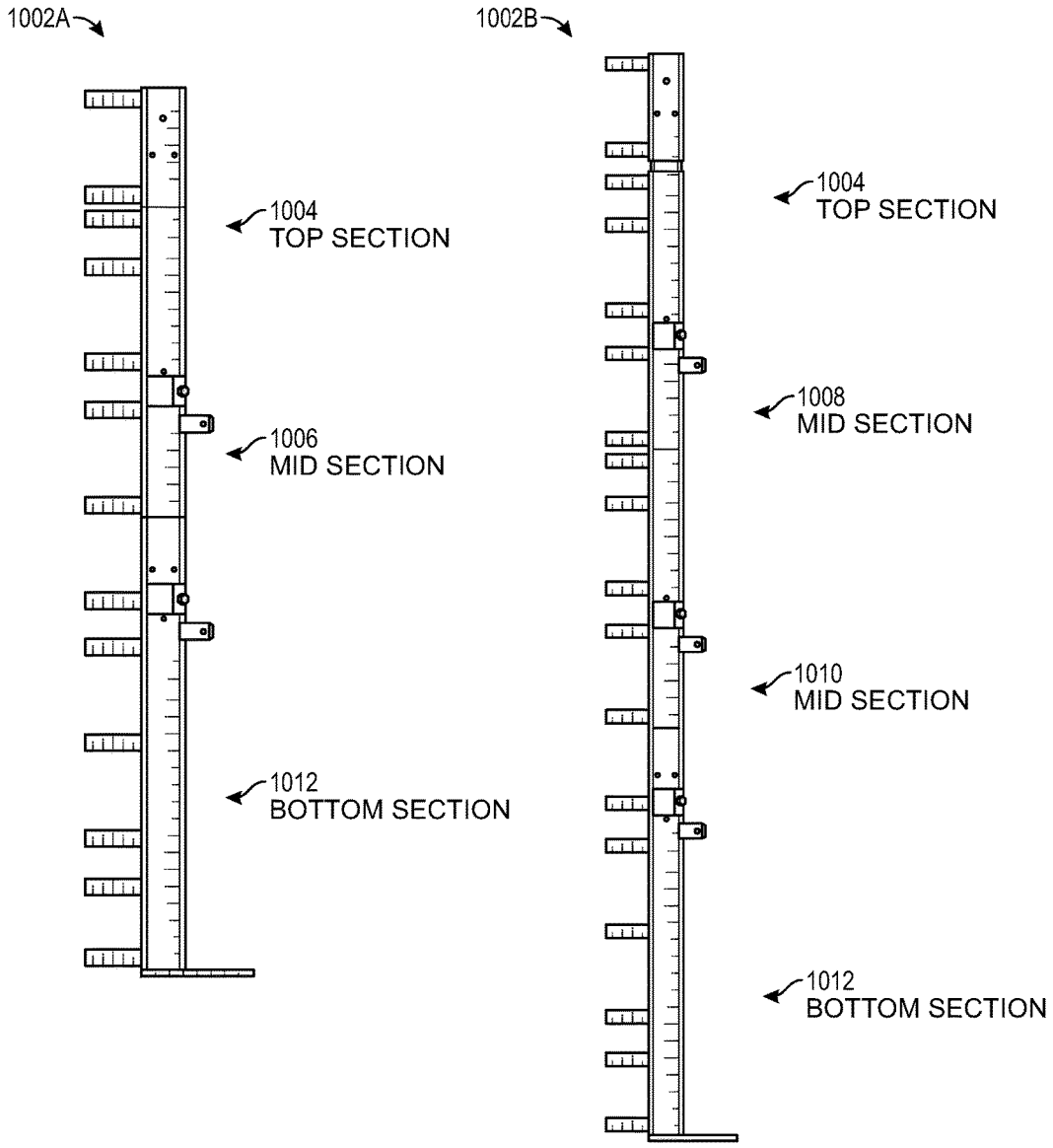
FIG. 10 illustrates the use of interchangeable sections (Lego block style) to enable the overall height of a post to be varied, according to various embodiments.

FIG. 10 illustrates the use of interchangeable sections (Lego block style) to enable the overall height of a post to be varied, such that a single base section can be combined with mid and top sections of varying length to minimize the parts count, according to various embodiments. With this scheme, a single adjustable bottom section 1012 can be used in conjunction with multiple non-adjustable mid sections 1006, 1008, 1010 having varying lengths, and a single adjustable top section 1004 to form posts of different lengths 1002*a* and 1002*b*. This allows the multi-flex form to support a single story structure of varying ceiling heights, and at the same time support 2 (and more) story buildings without having to change the top and bottom pieces which may be the only ones that need to be adjustable. Someone skilled in the art will appreciate that a post can be constructed using an arbitrary mix of fixed and adjustable sections, for example to facilitate the construction of a multi-story building with differing floor to floor heights. Further, the mix of fixed and adjustable sections can be varied to support differing slab thicknesses from floor to floor and building to building while minimizing the number of system components.

Figure 11:
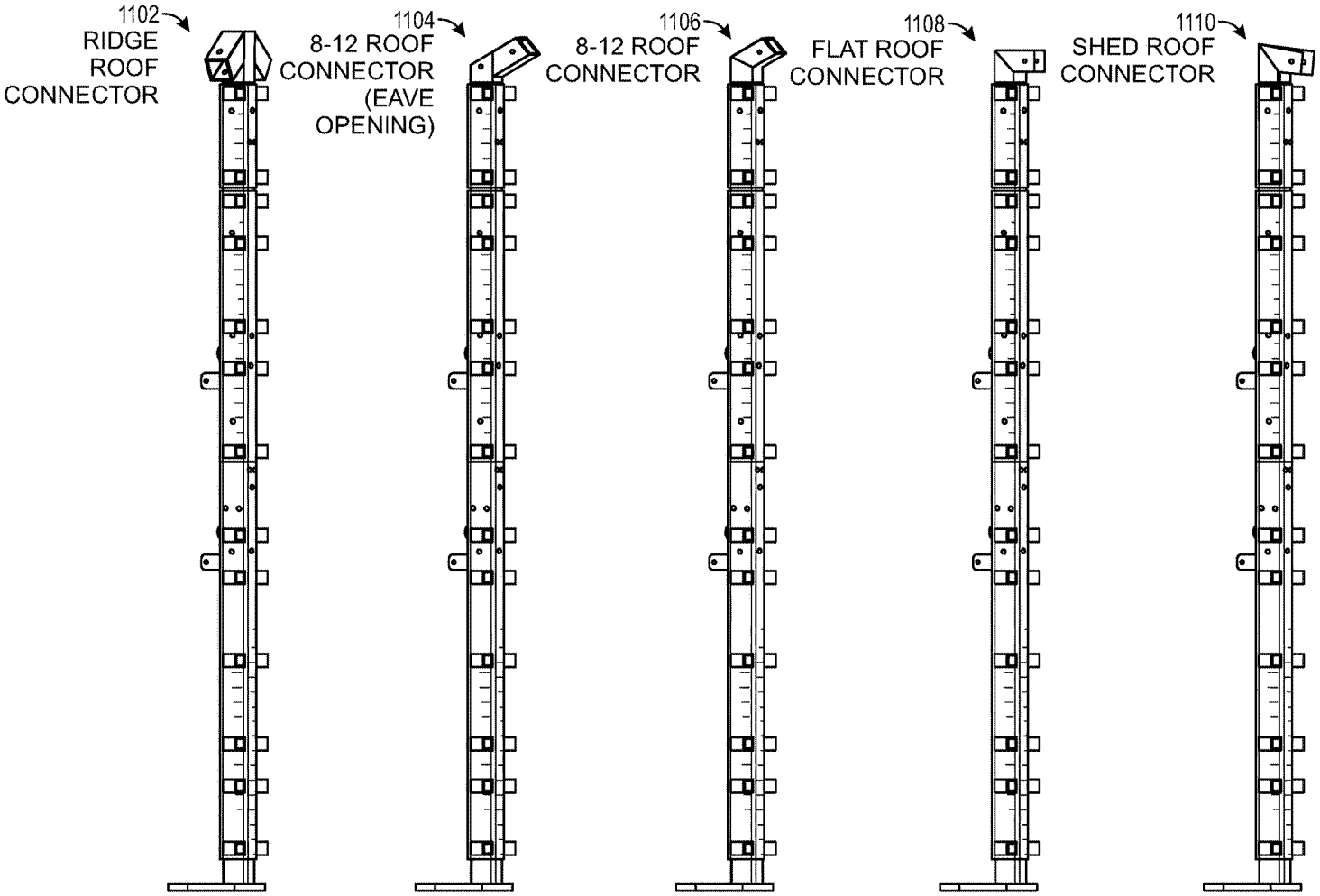
FIG. 11 illustrates the use of interchangeable sections to be able to support multiple roof configurations, according to various embodiments.

FIG. 11 illustrates the use of interchangeable sections to be able to support multiple roof configurations, according to various embodiments. As illustrated, these pieces use inverse stub mounting (male tube drops into a fixed female tube versus standard stub mounting where a female tube slips over a fixed male tube) to allow different fixed or adjustable roof connectors 1102-1110 to mate to a standard post to support varying roof geometries. In embodiments, the different fixed or adjustable roof connectors 1102-1110 may include a ridge roof connector, an 8-12 pitch roof connector with or without eave opening, a flat roof connector and/or a shed roof connector.

Figure 12:
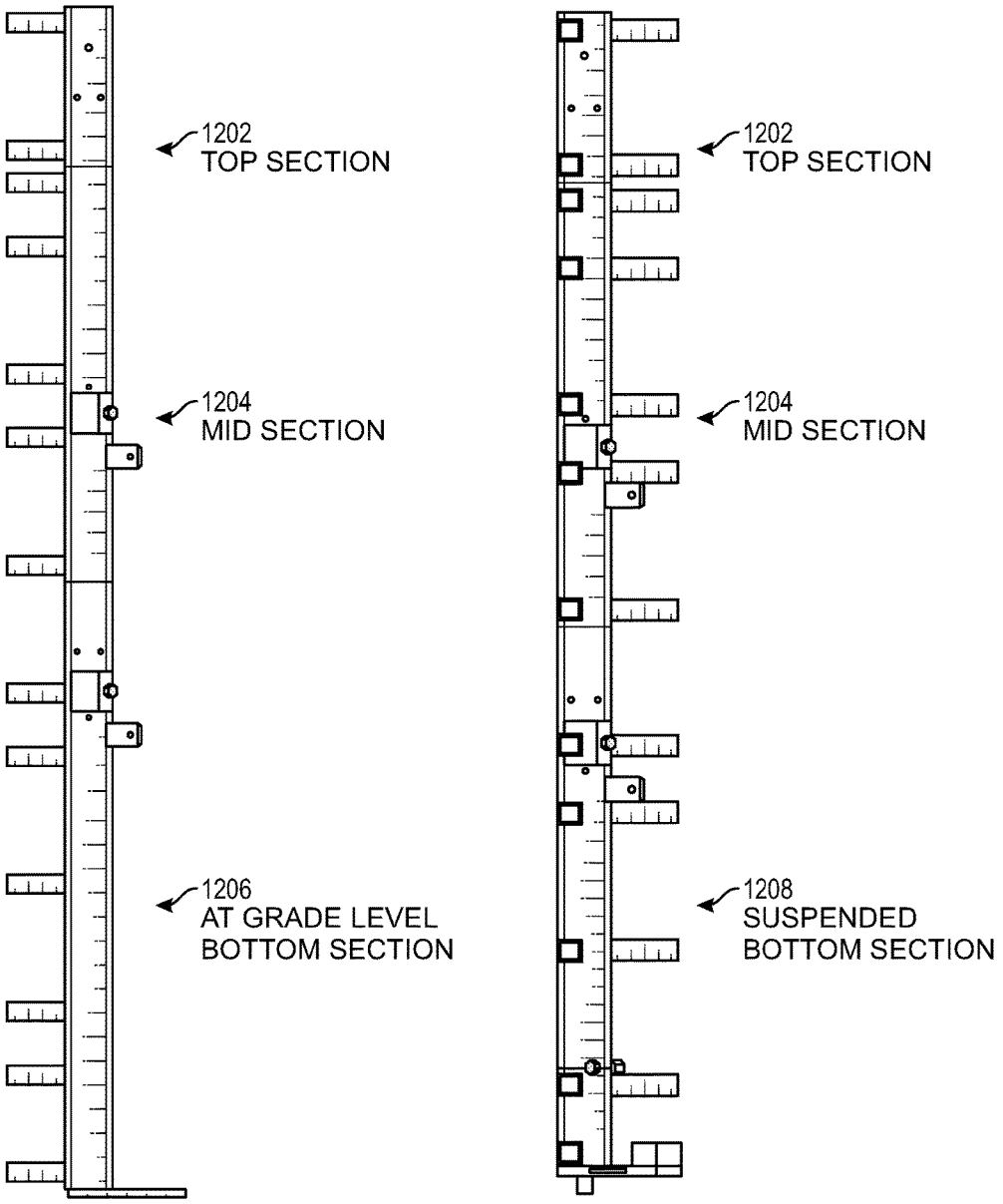
FIG. 12 illustrates the use of interchangeable sections to make core and jacket elements, according to various embodiments.

FIG. 12 illustrates the use of interchangeable sections to make core and jacket elements, having inline, inside corner, and outside corner configurations, use common pieces wherever possible, according to various embodiments. As illustrated, the jacket post on the left (at grade level bottom section) and the core post on the right (suspended bottom section) employ different bottom sections 1206 and 1208, but the mid and top sections 1202 and 1204 can be used by both types of post. Without the flexibility of this approach, a large number of different posts would otherwise be needed for the multi-flex form to handle varying configurations.

In the description thus far, for ease of understanding, the post types have been referred to as jacket and core and inside and outside corners. It should be noted that the term "core" post, in general, refers to the condition where the post is suspended in the air to enable a slab to be poured beneath it. Similarly, the term "jacket," in general, refers to the condition where the post is mounted at grade, and where no slab is to be poured under it. In some embodiments, a post in the jacket may be suspended to enable a "heel" configuration that is common in a retaining wall. In still other embodiments, the core posts may not need to be suspended because a slab could be poured later, or a slab may not even be required, and it would normally be easier to mount a post at grade rather than having to suspend it.

In other words, in embodiments, there may be 6 basic post configurations where the height of each post can vary even within a single structure:

1) At grade level, inside corner
2) At grade level, outside corner
3) Suspended, inside corner
4) Suspended, outside corner
5) Inline, suspended
6) Inline, at grade level With the Multi-Flex Forming System, all 6 posts having arbitrary overall lengths may have the following pieces:

1) Single adjustable at grade level inside corner bottom section
2) Single adjustable at grade level outside corner bottom section
3) Single adjustable suspended inside corner bottom section
4) Single adjustable suspended outside corner bottom section
5) Single adjustable suspended inline section)
6) Single adjustable at grade level inline section
7) Multiple fixed length mid sections (inside corner, outside corner, and inline) having varying lengths to support varying overall post heights
8) Single adjustable inside corner, outside corner, and inline top sections (system will work with only 1 top section, but certain post configurations may be easier to implement by varying the top section rather than the middle section, so we have multiple top section pieces)

In some embodiments, other pieces may be included; while in other embodiments, the distinction between suspended and at grade level may be entirely eliminated.

Figure 13:
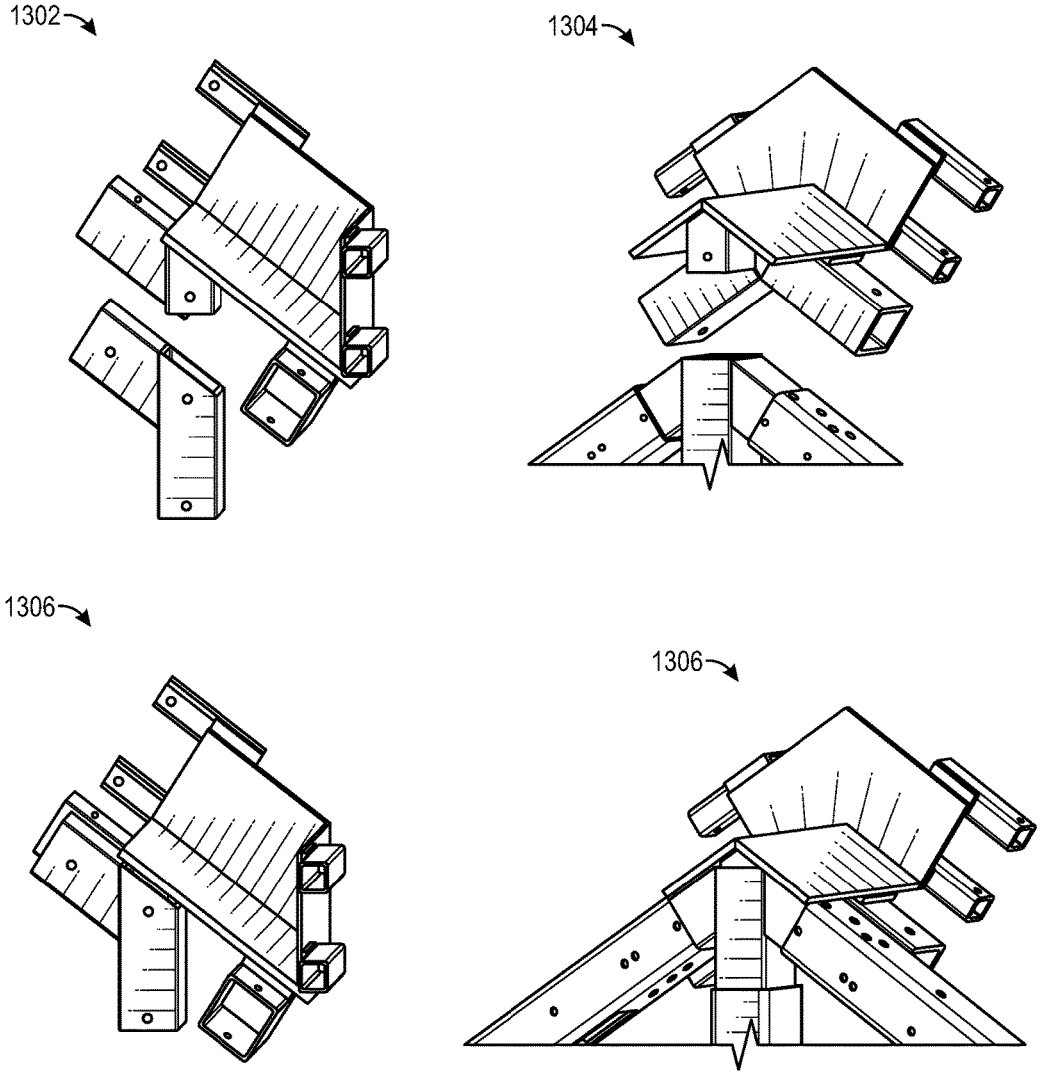
FIGS. 13 and 14 illustrate the use of drop-in (essentially inverse stub mounting) pieces to create the wall/roof junction under an eave of the building being formed, according to various embodiments.
Figure 14:
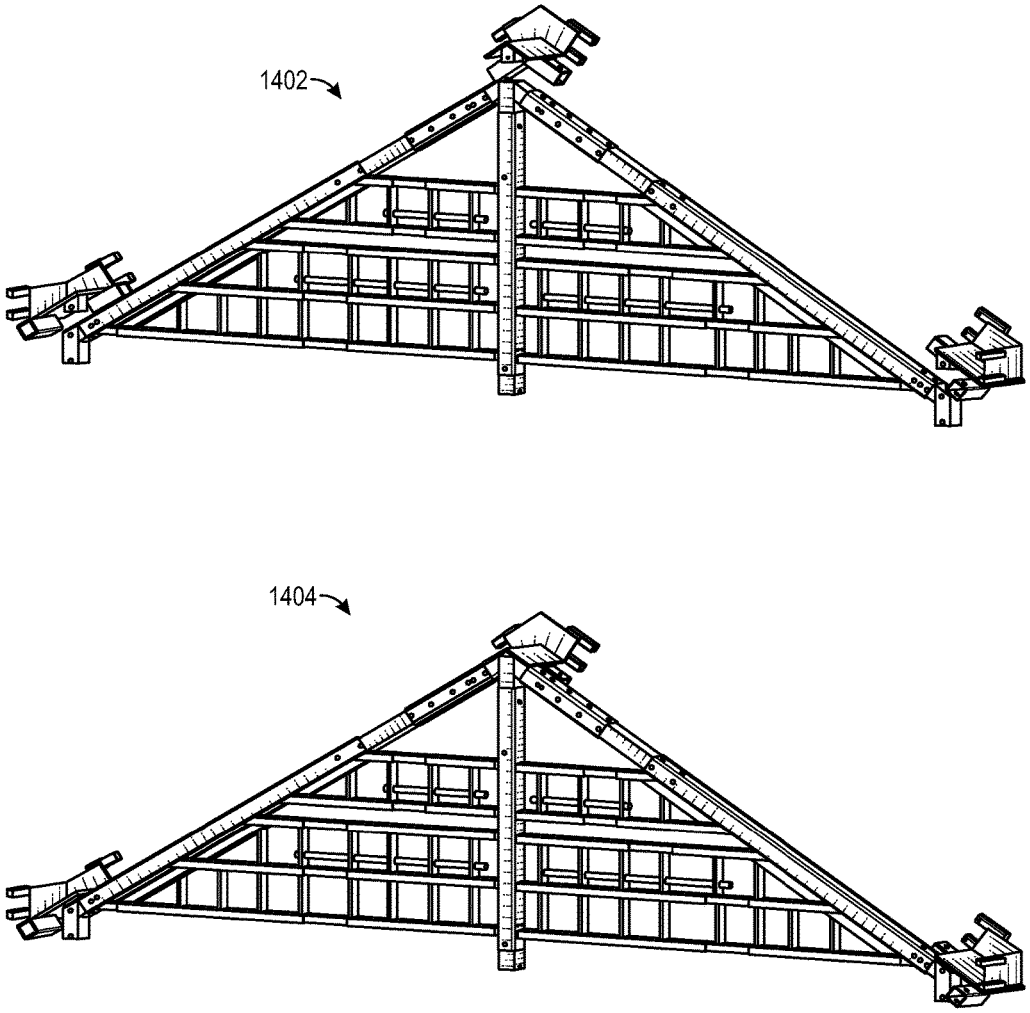

FIGS. 13 and 14 illustrate the use of drop-in (essentially inverse stub mounting) pieces to create the wall/roof junction under an eave of the building being formed, according to various embodiments. The picture 1302 at the top left corner of FIG. 13 shows a PTS (post to strut connector) that drops into the top of a post (inverse stub mount) with an eave plate that would drop into the PTS (also inverse stub mount), or could be welded to the PTS to create a corner eave assembly.

The picture 1304 at the top right corner of FIG. 13 shows a gable eave assembly. A PTS is shown with an angled plate welded to it to form the underside angle of the gable. The angled plate has a pair of stubs welded underneath and a vertical plate welded to its far side. The stubs underneath the angled plate allow for a strut to be connected to the gable eave assembly to carry the weight of the concrete that creates the eave. The vertical plate forms the face of the eave and the vertical plate has a pair of stubs welded to its backside. These stubs enable a double extended frame to be connected between the corner eave assembly and gable eave assembly to form the complete face of the eave. Someone skilled in the art will appreciate that the use of a double extended frame in this situation enables the facing to be cut to the exact length and then secured to the fixed frame such that the facing can be installed between the gable eave plate and corner eave plate as the frame is being installed.

The gable eave assembly then drops into the top of a post using an inverse stub mount, and is pinned in place. The 2 lower pictures 1306 in FIG. 13 show both plates mounted to their PTS's. The 2 overall pictures 1402 and 1404 in FIG. 14 show the complete assembly for a gable roof with an eave.

Figure 15:
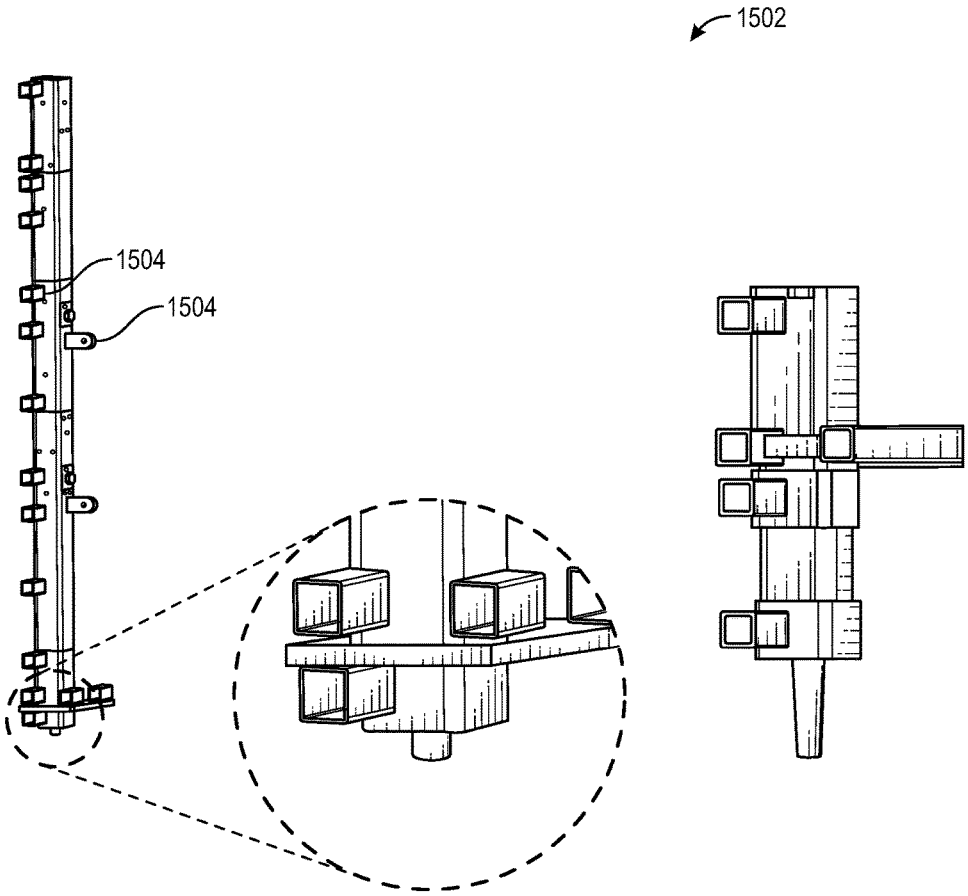
FIGS. 15 and 16 illustrate the use of offset stub patterns to facilitate a step in the floor, according to various embodiments.
Figure 16:
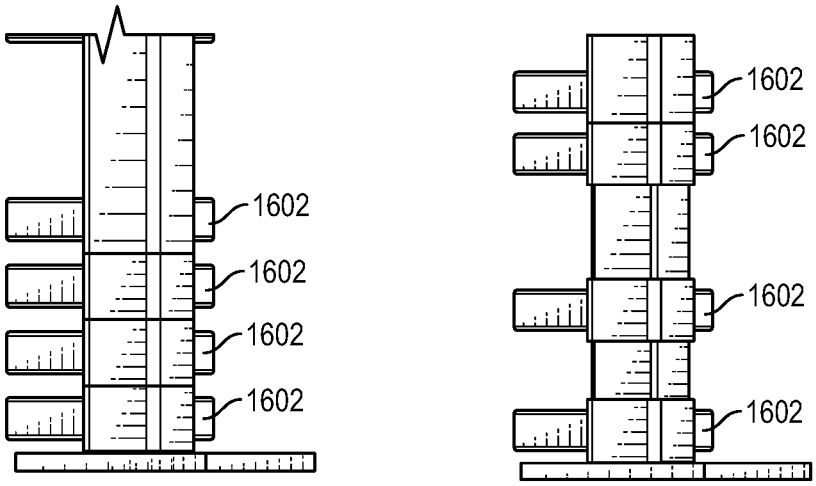

FIGS. 15 and 16 illustrate the use of offset stub patterns to facilitate a step in the floor, according to various embodiments. As shown, some tube frames 1502 may have stubs 1504 arranged in offset patterns to facilitate a step in the floor. As illustrated further in FIG. 16, multiple adjustable sections 1602 may be employed to support multiple floors having different heights.

Figure 17:
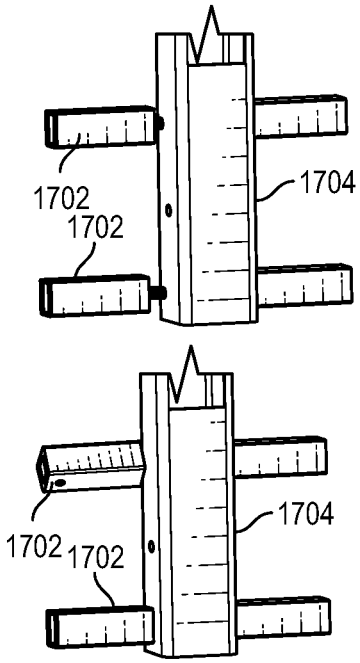
FIG. 17 illustrates the use of bolt on stubs, according to various embodiments.

FIG. 17 illustrates the use of bolt on stubs, according to various embodiments. Using bolt on stubs 1702 enables a single bare post section 1704 to be able to be configured to serve as an inside corner, outside corner, or inline post for one casting and then be changed into a different configuration for a subsequent pour/s. This flexibility would reduce the number of parts that would be required to comprise the entire family. In alternate embodiments, it would be possible to pin the stubs in place and/or machine the post and stub to fit together and lock in place.

Figure 18:
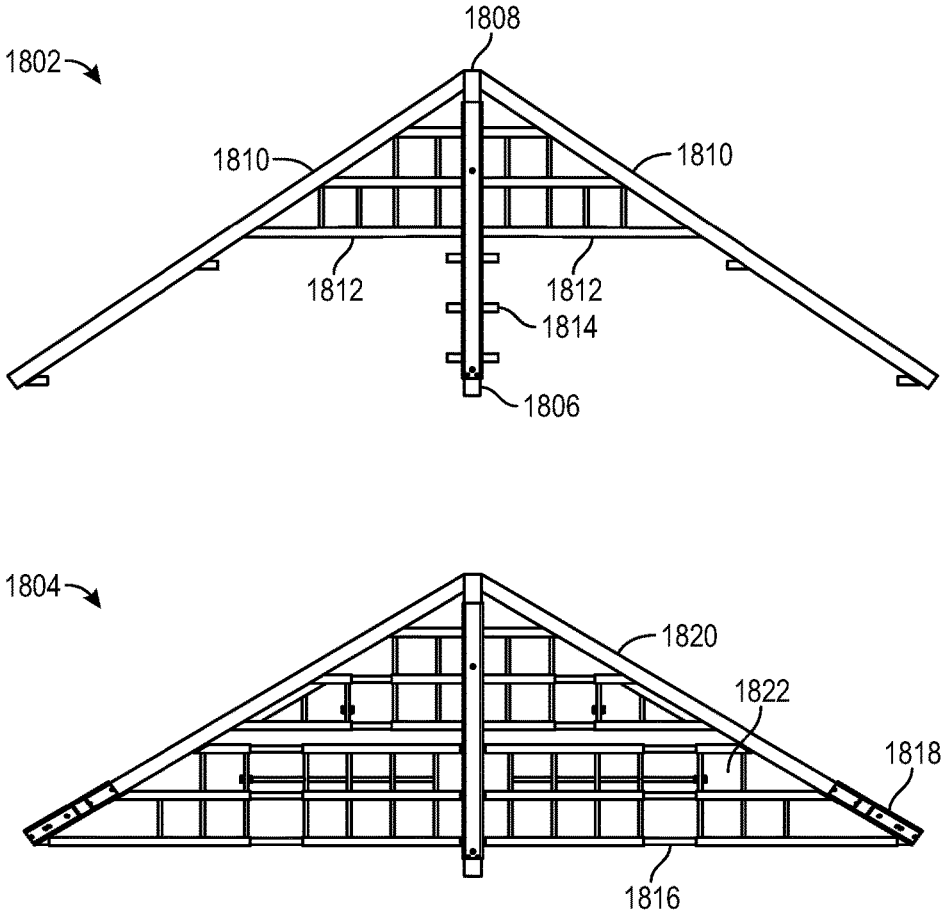
FIGS. 18 and 19 illustrate how posts, struts, and frames can be selectively combined to create a hybrid entity for forming the building, according to various embodiments.
Figure 19:
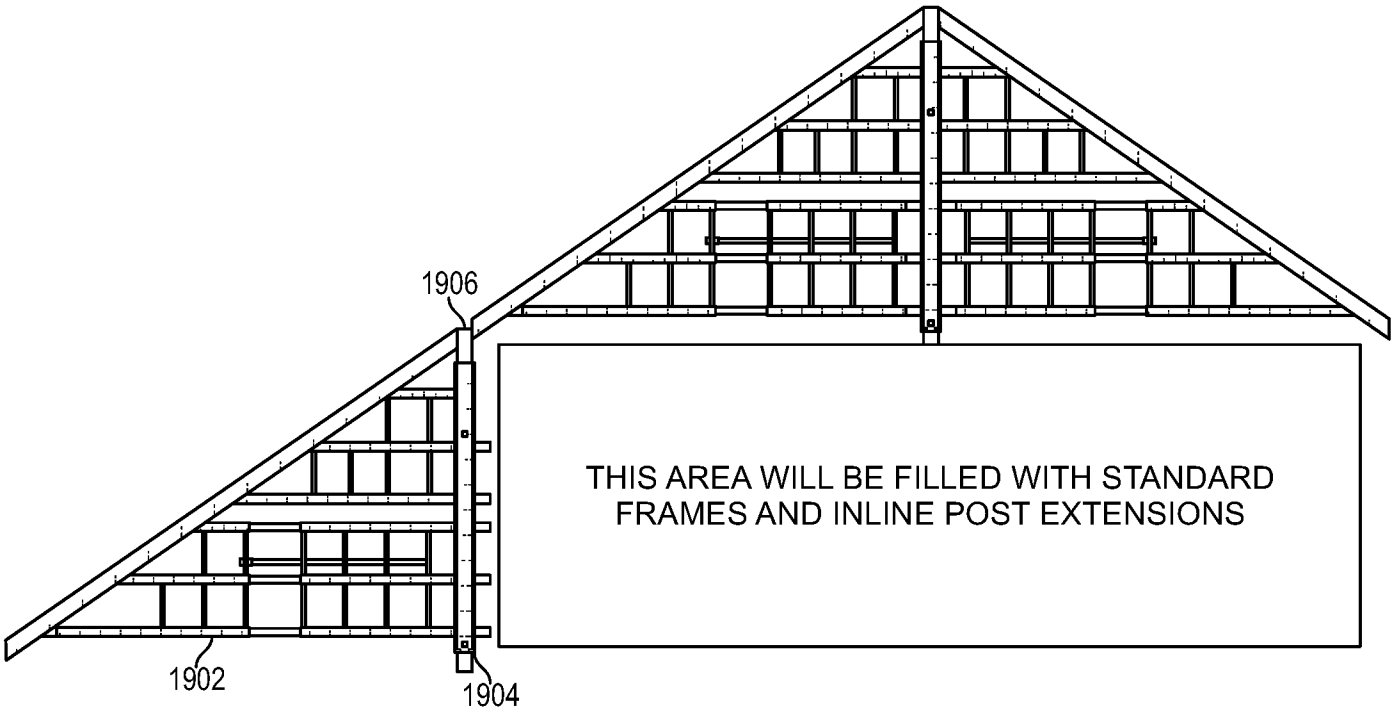

FIGS. 18 and 19 illustrate how posts, struts, and frames can be selectively combined to create a hybrid entity for forming the building, according to various embodiments. The top picture in FIG. 18 shows one embodiment of a hybrid assembly 1802 that can be used to form a gable roof. The top section of a post 1806 has a PTS 1808 welded to it, and the PTS 1808 has a pair of struts 1810 welded to it in opposing directions at the angle of the gable roof. A pair of fixed trapezoidal frames 1812 may be welded directly to the top of the post 1806 on one side and to the strut 1810 on the other side. Stubs 1814 may then be welded to the strut 1810 and post 1806, below the trapezoidal frames 1812, at standard spacing, such that standard fixed frames (not shown), with special extension sections that follow the roof pitch, can be installed. The lower picture of FIG. 18 shows another embodiment of a hybrid assembly 1804 where each of the large tube "wings" 1816 with an adjustable section 1818 connected to the fixed strut section 1820 along with a pair of frames 1822 mounted to stubs on the fixed and adjustable sections of the strut.

FIG. 19 shows how a very long gable roof would be formed. The next post 1904 may be essentially one half of the top picture of FIG. 18 with a special post to strut connector 1906 to tie the sections together. The half section 1902 could be connected to subsequent half sections as required and the entire assembly would terminate in a standard post (not shown) at the corner. A key advantage to this system is that the entire gable wall may be formed using standard fixed frames. To convert to a different roof pitch new hybrid assemblies, connector struts, and angled extension sections may be required, but standard posts and fixed frames would still be used. In alternate embodiments, the post to strut connectors could be adjustable to facilitate different roof pitches, for example, by incorporating a center hinge to enable one side to pivot.

Figure 20:
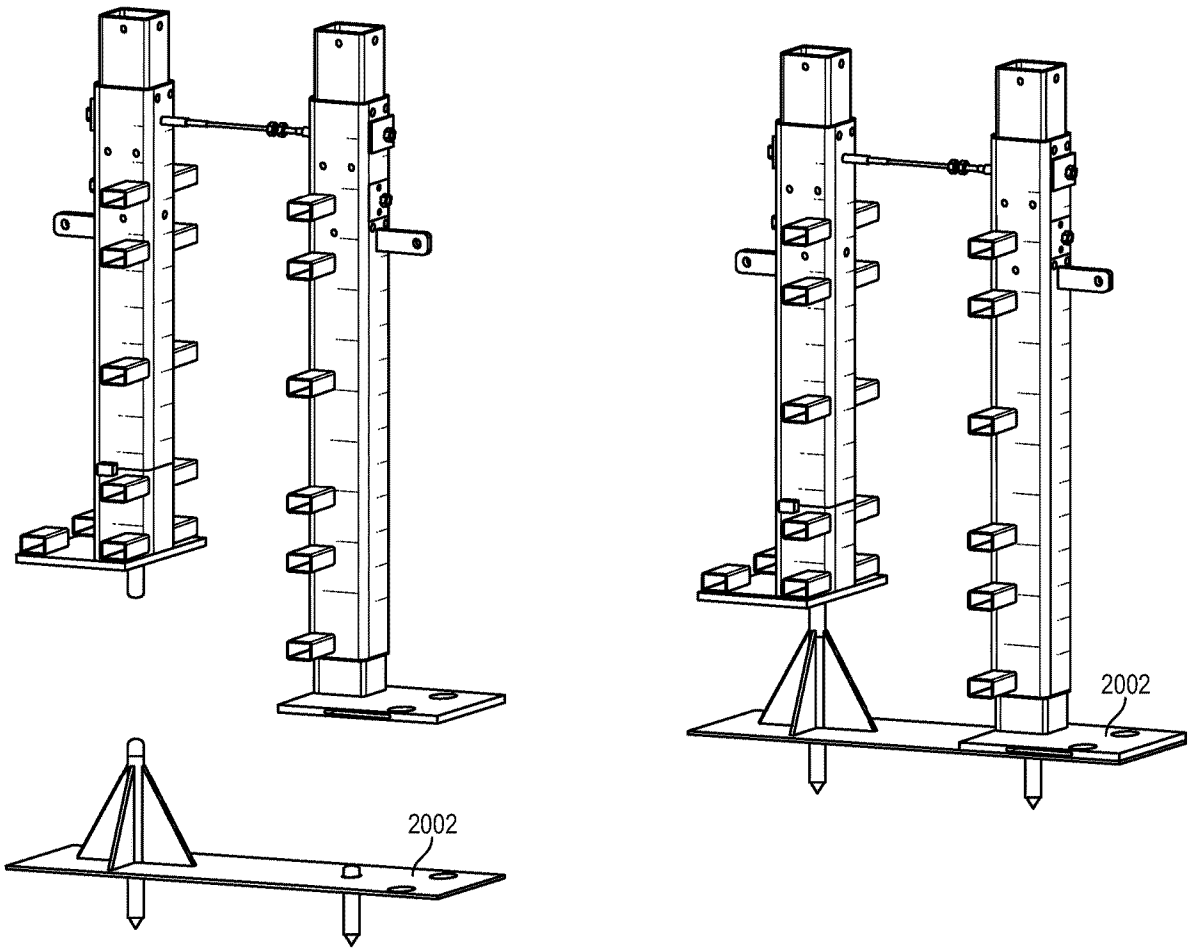
FIG. 20 illustrates the use of a mother plate to mount a post pair, and also serve as the bottom tie for the pair of posts, according to various embodiments.

FIG. 20 illustrates the use of a mother plate to mount a post pair, and also serve as the bottom tie for the pair of posts, according to various embodiments. A tie is shown at the top of the post pair. The left side of FIG. 20 shows an exploded view of the various pieces, the posts and the mother plate 2002. The right side of FIG. 20 shows an assembled view with the posts tied together at the bottom by the mother plate 2002.

Figure 21:
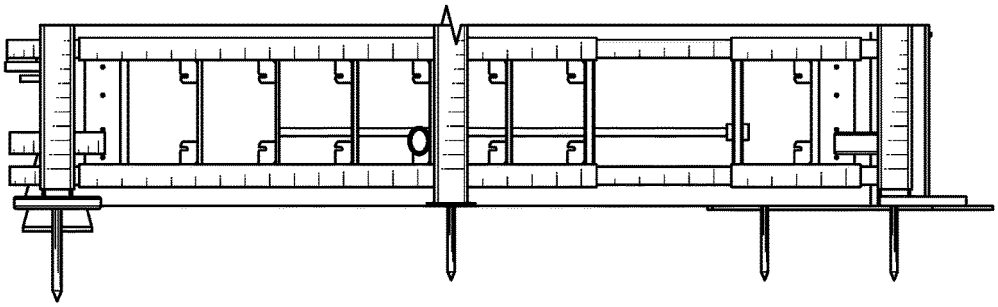
FIG. 21 illustrates the use of a combination of fixed and sliding stubs to mount the slab form, according to various embodiments.

FIG. 21 illustrates the use of a combination of fixed and sliding stubs to mount the slab form, according to various embodiments. As illustrated, an unused stub is disposed in between the female tubes of the mounted frame. The sliding stub allows the Multi-Flex Forming System to support varying slab thicknesses in this case, but it is a globally useful concept that provides some additional flexibility in areas where adjustability is needed, where a fixed stub would prevent achievement of the maximum possible adjustment. As illustrated, in these embodiments, the 2 fixed stubs (i.e., a) top stub that has the frame mounted to it and b) middle stub that is not used) that are welded to the posts may be designed to support the minimum 9" thick slab. But, the 3.5" male tube (the tube that the sliding stub moves on; and has the base plate welded or bolted to it) inside the 4"×4" post may have about 16" of adjustment. So by using a sliding stub, the multi-flex form can extend the male tube 3", insert a sliding stub, and use the top fixed stub and the sliding bottom stub to support a 12" slab. By extending the 3.5" male tube 7", the same post can support a 16" slab and so forth. At near full extension of the 3.5" male tube, the example post can support a 24" thick slab. With this thick of a slab, multiple sliding stubs may be employed, or a single sliding element with multiple stubs could be used. Someone skilled in the art will appreciate that a sliding element with stubs on one side only, or with more stubs on one side than the other, could be used to facilitate a step in the slab.

Figure 22:
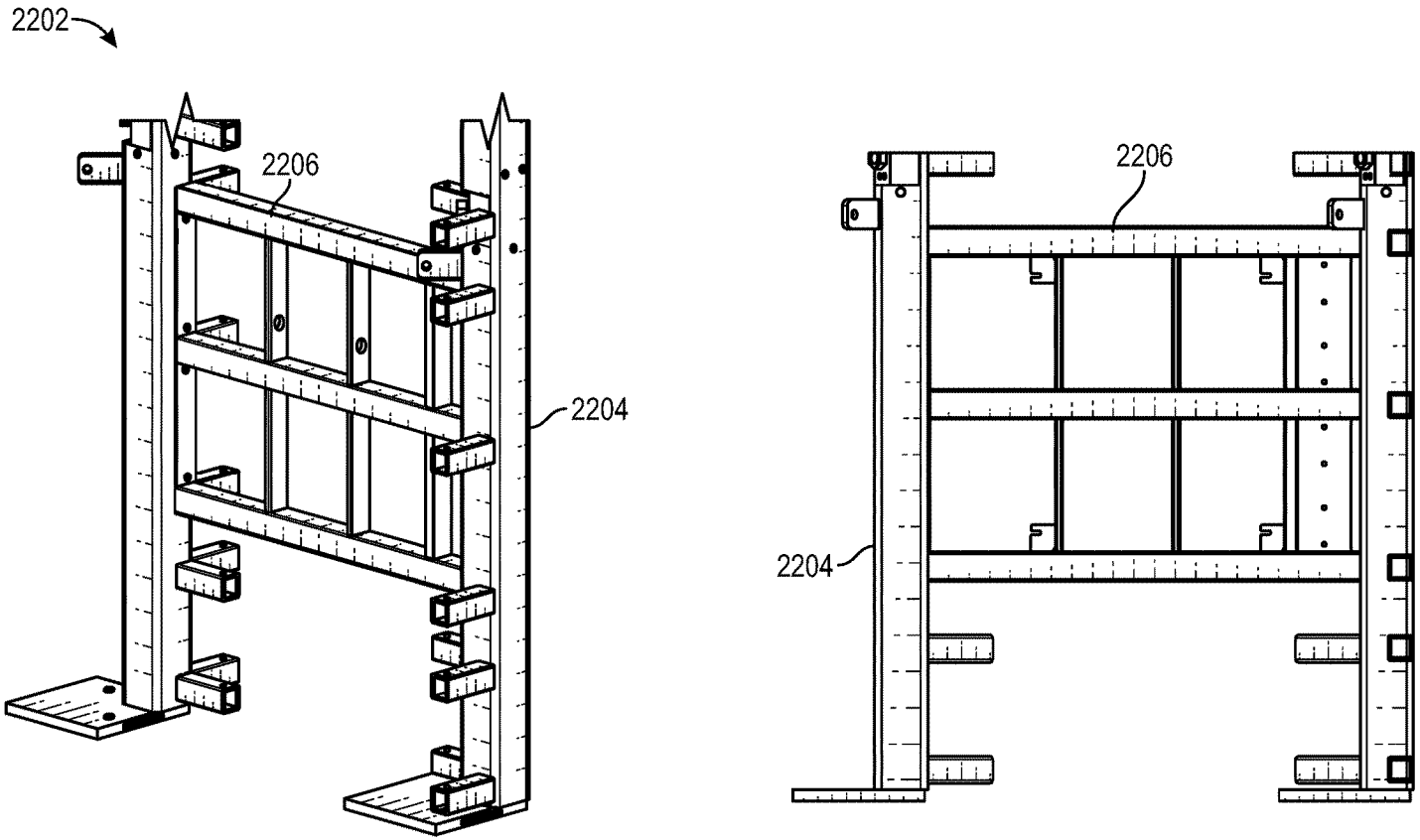
FIG. 22 illustrates another example of forming hybrid components, according to various embodiments.

FIG. 22 illustrates another example of forming hybrid components, according to various embodiments. As shown, a hybrid component 2202 can be formed by bolting or welding a fixed frame to a pair of posts. The example hybrid component 2202 may be used to support a short jog in a wall. Two standard posts 2204 could use fixed frames 2206 of certain sizes to support standard jogs of 12", 18", 24", 30", and 36" for example. This is useful where the length of the short wall is less than the minimum distance that is supported by the smallest standard adjustable frame. Someone skilled in the art will recognize that this same "jog" configuration can be realized by welding perpendicular stubs to the back side of the frame 2206 on the left end and to the front side of frame 2206 on the right end or by creating a special "Z-shaped" fixed frame with extension sections on one or both sides.

Figure 23:
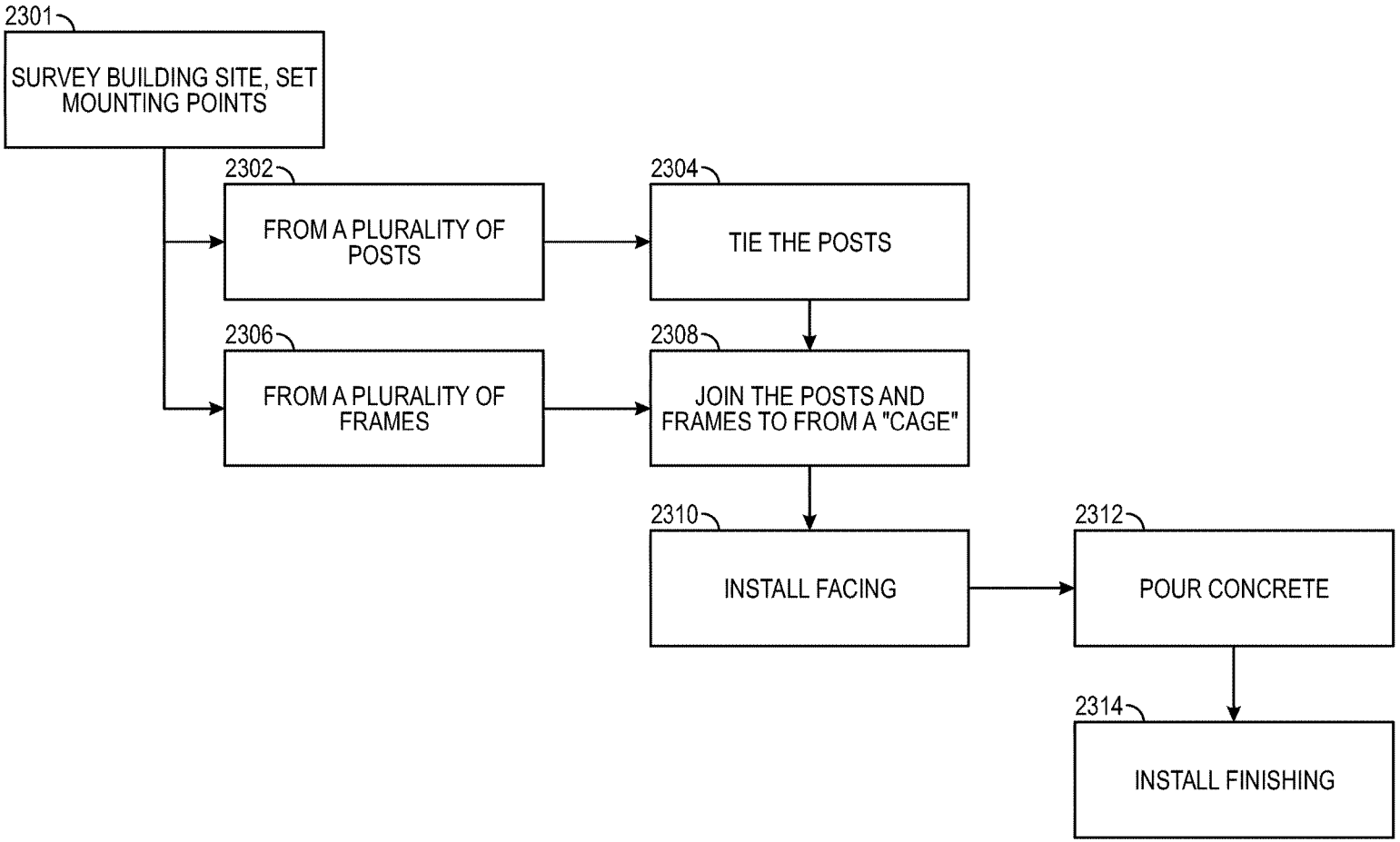
FIG. 23 illustrates a method for constructing a concrete building on site with reduced number of pours.

FIG. 23 illustrates a method for constructing a concrete building on site with reduced number of pours. As illustrated, the method 2300 for constructing a concrete building on site, with reduced number of pours, may include the operations performed at blocks 2301-2312. At block 2301, the building site may be surveyed, and the mount points set at the correct locations. From 2301, method 2300 may proceed to block 2302 and/or 2306.

At block 2302, support posts of various lengths and/or footing configurations (i.e. at grade or suspended) may be formed. At block 2304, the various posts may be selectively tied together.

At block 2306, frames of various dimensions and/or shapes may be formed. Frames may include hybrid frames formed with standard extensible frames and adjustable posts. At block 2308, the various posts and frames may be joined together to form a "cage," where the cage may optionally be tied together as required. The "cage" may provide for support for forming a building with the desired number of stories including the roof.

Additionally, at blocks 2302-2308 various finishing, such as, but are not limited to sections of plumbing, electrical conduits/wiring, and/or drain piping can be installed. For examples, certain electrical conduits/wires may be tied to the rebar.

At 2310, the facings may be attached to the "cage." At 2312, concrete may be poured to form the building on site, with reduced number of pours, as little as a single pour, if desired.

At 2314, additional finishing may be installed. Additionally, finishing may include roof tile, interior drainage system, hot/cold water supply, sewer, electrical wires/conduits, electrical boxes, and so forth Although certain embodiments have been illustrated and described herein for purposes of description, a wide variety of alternate and/or equivalent embodiments or implementations calculated to achieve the same purposes may be substituted for the embodiments shown and described without departing from the scope of the present disclosure. This application is intended to cover any adaptations or variations of the embodiments discussed herein. Therefore, it is manifestly intended that embodiments described herein be limited only by the claims.

Where the disclosure recites "a" or "a first" element or the equivalent thereof, such disclosure includes one or more such elements, neither requiring nor excluding two or more such elements. Further, ordinal indicators (e.g., first, second or third) for identified elements are used to distinguish between the elements, and do not indicate or imply a required or limited number of such elements, nor do they indicate a particular position or order of such elements unless otherwise specifically stated.

What is claimed is:

1. An apparatus for constructing a concrete structure at a construction site, comprising:

a plurality of adjustable posts adjustable in a vertical direction to accommodate various elevations of mount points of the construction site;

a plurality of extensible frames with extensible sections extensible in one or more dimensions; and a plurality of fixed or adjustable mounts;

wherein the adjustable posts, the extensible frames, and the fixed or adjustable mounts are selectively and adjustably coupled together to create an adjustable, retractable or collapsible form of selected dimensions to construct the concrete structure at the construction site;

wherein the concrete structure is a concrete building having a roof of a particular type and geometry, and the apparatus further comprises a plurality of adjustable roof struts to be selectively and adjustably coupled together with one or more of the plurality of adjustable posts or one or more of the plurality of extensible frames to create the form of selected dimensions to construct the concrete building at the construction site, the plurality of adjustable roof struts being adjustable to accommodate formation of the concrete building with the roof of the particular type and geometry;

wherein the plurality of extensible frames comprise a plurality of magnetic bases to attach a plurality of facings to the extensible frames, wherein the magnetic bases are mounted to the extensible frames using square gussets welded in corners of the extensible frames, and wherein at least one of the facings comprises an aluminum skin with a steel frame attached to it.

2. The apparatus of claim 1 further comprising a plurality of ties to selectively couple at least the adjustable posts and the extensible frames to create the form.

3. The apparatus of claim 1, further comprising the plurality of facings are removably attached to selected ones of the plurality of extensible frames to form a plurality of cavities for concrete to be poured.

4. The apparatus of claim 1, wherein the plurality of extensible frames comprise a plurality of single tube frames to support formation of the roof of the concrete building, wherein one or more of the single tube frames comprise stubs mounted on one side, on opposing sides, or on adjacent sides to carry additional roof struts or gable wall forms.

5. The apparatus of claim 1, wherein the concrete building is to have a second level floor, and the plurality of extensible frames comprise a plurality of multi-tube frames to support formation of the second level floor of the concrete building, wherein one or more of the multi-tube frames comprise stubs mounted to them at 90 degrees to a primary plane of the multi-tube frame to carry the second level floor to be formed.

6. The apparatus of claim 1, wherein the concrete building is to have a door, and at least one of the plurality of extensible frames comprise a U-shaped frame having independent extension sections on both sides of the U-shaped frame, to perform a blockout function around the door of the concrete building, so that people can enter an interior space of the concrete building, while concrete is being poured to construct the concrete building at the construction site, wherein the multiple independent extension sections comprise differing lengths.

7. The apparatus of claim 6, wherein at least one of the independent extension sections of the U-shaped frame comprises one or more drive screws.

8. The apparatus of claim 1, wherein the concrete building is to have a gable roof, and at least one of the plurality of extensible frames comprise a fixed frame section having a pair of opposing extension sections to facilitate forming the gable roof of the concrete building, wherein the pair of opposing extension sections include perpendicular stubs to carry weight of a ceiling of the concrete building being formed; wherein the pair of opposing extension sections are opposing each other relative to the fixed frame.

9. The apparatus of claim 1, wherein at least one of the plurality of adjustable posts, the plurality of extensible frames, or the plurality of adjustable roof struts comprise two or more stub trees to independently establish elevations for a top or a bottom of one or more floors or a roof of the concrete building being formed.

10. The apparatus of claim 1, wherein one or more of the plurality of adjustable posts comprise one or more interchangeable sections, to enable an overall height of a post to be varied in the vertical direction, wherein at least one of the adjustable post comprises a single base section combined with a mid or a top section of varying length to form the at least one adjustable post.

11. The apparatus of claim 1, further comprising a plurality of roof connectors, including a ridge roof connector, a pitched roof connector with or without eave opening, a flat roof connector or a shed roof connector, to be selectively employed to couple with selected ones of the adjustable post, extensible frames or adjustable roof struts to create the form of selected dimensions to construct the concrete building at the construction site, based at least in part on the particular type and geometry of the roof of the concrete building.

12. The apparatus of claim 1, wherein the plurality of adjustable posts comprise a core post and a jacket post, wherein respective bottom sections of the core post and jacket post are different, and respective mid or top sections of the core post and jacket post are the same.

13. The apparatus of claim 1, further comprises a plurality of post to strut connectors to create one or more wall/roof junctions under one or more eaves of the concrete building being formed, wherein a post to strut connector comprises either a drop in or a welded eave plate.

14. The apparatus of claim 1, wherein one or more of the plurality of extensible frames comprise stubs arranged in offset patterns to facilitate a step in a floor of the concrete building being formed, wherein at least one of the extensible frames include multiple extension sections to support multiple floors of the concrete building being formed, wherein the multiple floors have different heights.

15. The apparatus of claim 1, wherein one or more of the adjustable posts comprise bolt on stubs to enable a single bare post section to be configured to serve as a selected one of an inside corner, outside corner, or inline post for the concrete building being formed, and another selected one of the inside corner, outside corner, or inline post for another concrete building being later formed.

16. The apparatus of claim 1, wherein selected ones of the adjustable posts or the extensible frames are combined to form one or more hybrid assemblies.

17. The apparatus of claim 16, wherein at least one of the hybrid assemblies comprise a fixed frame bolted to a pair of the adjustable posts, to support a short jog in a wall.

* * * * *